US006379229B1

(12) United States Patent
Wakabayashi et al.

(10) Patent No.: US 6,379,229 B1
(45) Date of Patent: Apr. 30, 2002

(54) POLISHING APPARATUS

(75) Inventors: Satoshi Wakabayashi; Tetsuji Togawa; Nobuyuki Takada; Kuniaki Yamaguchi, all of Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/572,278

(22) Filed: May 17, 2000

(30) Foreign Application Priority Data

May 17, 1999 (JP) ..... 11-136086
May 17, 1999 (JP) ..... 11-136088

(51) Int. Cl.[7] ..... B24B 7/04
(52) U.S. Cl. ..... 451/72; 451/443; 451/56
(58) Field of Search ..... 451/72, 41, 443, 451/56, 444, 287, 288

(56) References Cited

U.S. PATENT DOCUMENTS 5,770,521 A * 6/1998 Pollock ..... 438/692
6,040,244 A * 3/2000 Arai et al. ..... 438/691
6,116,987 A * 9/2000 Kubo ..... 451/41
6,116,994 A * 9/2000 Ito et al. ..... 451/288
6,200,207 B1 * 3/2001 Hsu ..... 451/443
6,217,426 B1 * 4/2001 Tolles et al. ..... 451/285
6,241,578 B1 * 6/2001 Togawa et al. ..... 451/5
6,241,592 B1 * 6/2001 Togawa et al. ..... 451/288
6,263,605 B1 * 7/2001 Vanell ..... 41/443

FOREIGN PATENT DOCUMENTS

JP 11033984 A * 2/1999 ..... B24B/37/00
JP 11-156712 6/1999
JP 2000280165 A * 10/2000 ..... B24B/37/00

OTHER PUBLICATIONS

Co–pending U.S. Patent Application Serial No. 09/341,882, Jul. 20, 1999, by Seiji Katsouka et al., entilted "Polishing Apparatus", located in Group Art Unit 1743.

* cited by examiner

*Primary Examiner*—Joseph J. Hail, III
*Assistant Examiner*—David B. Thomas
(74) *Attorney, Agent, or Firm*—Wenderoth, Lind & Ponack, L.L.P.

(57) ABSTRACT

A polishing apparatus has a polishing table having a polishing surface, a carrier for carrying a plate-like member and bringing the plate-like member into contact with the polishing surface, and a dresser including a dressing tool adapted to be brought into contact with the polishing surface to dress or normalize the polishing surface. The carrier is movable along a first path between a work position for bringing into contact the plate-like member with the polishing surface and a rest position. The dresser is movable along a second path between a work position for bringing the dressing tool into contact with the polishing surface and a rest position. The first and second paths have a common overlapping area. A contact prevention device is provided to prevent the carrier and the dresser from coming into contact with each other. An actuator is provided to bring the plate-like member into a condition that a predetermined area of the surface of the plate-like member extends beyond a peripheral edge of the polishing surface.

21 Claims, 8 Drawing Sheets

POLISHING APPARATUS

BACKGROUND OF THE INVENTION

The present invention relates to a polishing apparatus for polishing a plate-like article such as a semiconductor wafer.

With recent rapid progress in technology for fabricating high-integration semiconductor devices, circuit wiring patterns have been becoming increasingly fine and, as a result, spaces between wiring patterns have also been decreasing. As wiring spacing decreases to less than 0.5 microns, the depth of focus in circuit pattern formation in photolithography or the like becomes shallower. Accordingly, surfaces of semiconductor wafers on which circuit pattern images are to be formed by a stepper are required to be polished by a polishing apparatus to an exceptionally high degree of surface flatness. To accomplish such a high degree of surface flatness, it has become common to use a polishing apparatus known as "CMP" or "Chemical Mechanical Polisher".

FIG. 12 shows a polishing apparatus of this type. The apparatus includes a polishing table 102 provided with a polishing cloth 100 on its upper surface, a wafer carrier 104 for carrying a semiconductor wafer W to be polished and an abrasive liquid supply nozzle 106 for supplying an abrasive liquid to the polishing cloth 100. In a polishing operation, a wafer W is held on a lower surface of a wafer carrier 104 to be brought into contact with a surface (polishing surface) of the polishing cloth 100 which is provided on the polishing table 102, with the wafer carrier 104 and the polishing table 102 being rotated about their respective axes. Simultaneously, the abrasive liquid nozzle 106 supplies the polishing cloth 100 with an abrasive liquid consisting of, for example, an alkaline slurry containing abrasive particles such as silica which effects polishing of the semiconductor wafer chemically and mechanically.

The polishing apparatus is also generally provided with a dresser tool 108 which is employed to normalize the polishing surface of the polishing cloth either during or after polishing of a semiconductor wafer. When brought into contact with the polishing surface of the polishing cloth 100, the dresser tool 108 is rotated so as to remove any accumulated abrasive particles and debris and planarize the polishing surface. The wafer carrier 104 and the dressing tool 108 are pivotably supported on struts (not shown) positioned adjacent to and radially outside the polishing table 102, so as to enable each unit to be moved between a work position shown in FIG. 11 and a rest position radially outside the polishing table 102.

The polishing surface of the polishing table 102 is subject to a decrease in rotational movement the closer it is to the center of rotation. Accordingly, during polishing, a semiconductor wafer is brought into contact only with a polishing surface remote from the center axis, thus making it necessary for a diameter of a polishing table to be in excess of twice that of a wafer to be polished. Consequently, a large polishing apparatus must be employed whereby production and installation costs increase.

In an attempt to overcome this problem, there has been employed a polishing apparatus in which a polishing table having a polishing surface is driven in such a manner as to generate a circulatory translational motion thereof in which the polishing table is rotated about an axis spaced away from and parallel to the central axis of the polishing table without any change in orientation of the polishing table, whereby every point on the polishing surface is caused to describe a substantially identical locus, i.e., a circle. The motion of the polishing surface relative to a surface of a semiconductor wafer enables the polishing surface to polish the wafer surface uniformly at all the points of the polishing surface. Consequently, this enables a small diameter polishing surface of a polishing table to be employed having a diameter which is generally equal to that of a semiconductor wafer and is able to polish the semiconductor wafer appropriately.

However, the reduced size of the polishing table gives rise to the following problems. Firstly, the work positions of a dresser tool and a wafer carrier, which units are located above the polishing surface of the polishing table, overlap with each other, whereby the possibility of accidental contact and damage increases. In addition, following completion of a polishing operation, the wafer carrier must be raised to separate a polished wafer from the polishing surface of the polishing table. However, the existence of an abrasive liquid between the polished wafer and the polishing surface generates surface tension, requiring a relatively large force to be applied in order to separate a polished wafer from the polishing surface. Thus, upon completion of a polishing operation, the wafer carrier is generally first pivoted about its holding strut positioned outside of the polishing table to move the wafer to a position where a potion of the wafer extends radially outwardly from the periphery of the polishing surface of the polishing table, whereby surface tension is decreased prior to raising of the wafer carrier and separation of the polished wafer from the polishing surface. However, the circulatory translational motion applied to the polishing table as stated above, results in a shifting effective center point in the polishing table, with the peripheral edge of the polishing table thus becoming indeterminate. Accordingly, if the wafer carrier is, as stated above, moved to a predetermined position before being lifted from the polishing surface, the actual area of the wafer which is in contact with the polishing surface is indefinite, as is the surface tension acting between the wafer and the polishing surface. As a result, it becomes difficult to effectively separate a polished wafer from a polishing surface, and the likelihood of inappropriate movement and consequential damage to the wafer increases.

SUMMARY OF THE INVENTION

The present invention aims to solve the problems stated above.

According to the present invention, a polishing apparatus comprises a polishing table having a polishing surface, a carrier for carrying a plate-like member such as a semiconductor wafer and bringing the plate-like member into contact with the polishing surface, and a dresser including a dressing tool adapted to be brought into contact with the polishing surface to dress or normalize the polishing surface. The carrier is movable along a first path between a work position for bringing the platelike member into contact with the polishing surface and a rest position located radially outside the polishing surface, and the dresser is movable along a second path between a work position and a rest position. The second path and the first path have a common overlapping area.

The polishing apparatus further comprises a contact prevention means for preventing the carrier and the dresser from coming into contact with each other during movement along the stated first and second paths.

The contact prevention means may be designed so as to prevent the carrier and the dresser from entering simultaneously any overlapping area.

The polishing apparatus may further comprise means for 25 sensing that a carrier and dresser have approached each other beyond a predetermined limit, whereby movement of either or both units is halted.

The carrier and the dresser may be mechanically connected to each other so as to be able to be moved simultaneously along the first and second path, respectively.

According to another aspect of the present invention, a polishing apparatus comprises a polishing table having a polishing surface, a carrier for carrying a plate-like member such as a semiconductor wafer and bringing the plate-like member into contact with the polishing surface to polish a surface of the plate-like member, a circulatory translational motion mechanism for generating a relative circulatory translational motion between the polishing table and the carrier while maintaining constant contact of the plate-like member with the polishing surface, and an actuator for moving the carrier relative to the polishing surface, to bring the plate-like member into a condition where a predetermined area of the surface of the plate-like member extends beyond a peripheral edge of the polishing surface. Incidentally, the term "circulatory translational motion" noted above is defined as "a motion wherein every point on an article moves along closed paths in parallel with each other. The closed path may be in the form of, for example, a circle, an ellipse and a polygon. Accordingly, it should be understood that the "relative circulatory translational motion" noted above causes every point on the polishing surface to describe a substantially identical locus with respect to the plate-like member.

The polishing apparatus may comprise means for halting the said relative circulatory translational motion in such a state that the plate-like member has a predetermined orientation at a predetermined position relative to the polishing surface. The circulatory translational motion means generates a circulatory translational motion of the polishing table while the carrier is positioned at a predetermined position to keep the plate-like member stationary. The polishing apparatus may include a sensor positioned adjacent to the polishing table for sensing that a predetermined reference point on the polishing table has passed the sensor whereby a signal is emitted, in response to which the circulatory translational motion of the the polishing table is halted by the halting means once the table reaches a predetermined position relative to the emission of the sensor signal.

DETAILED DESCRIPTION OF THE INVENTION

Figure 1:
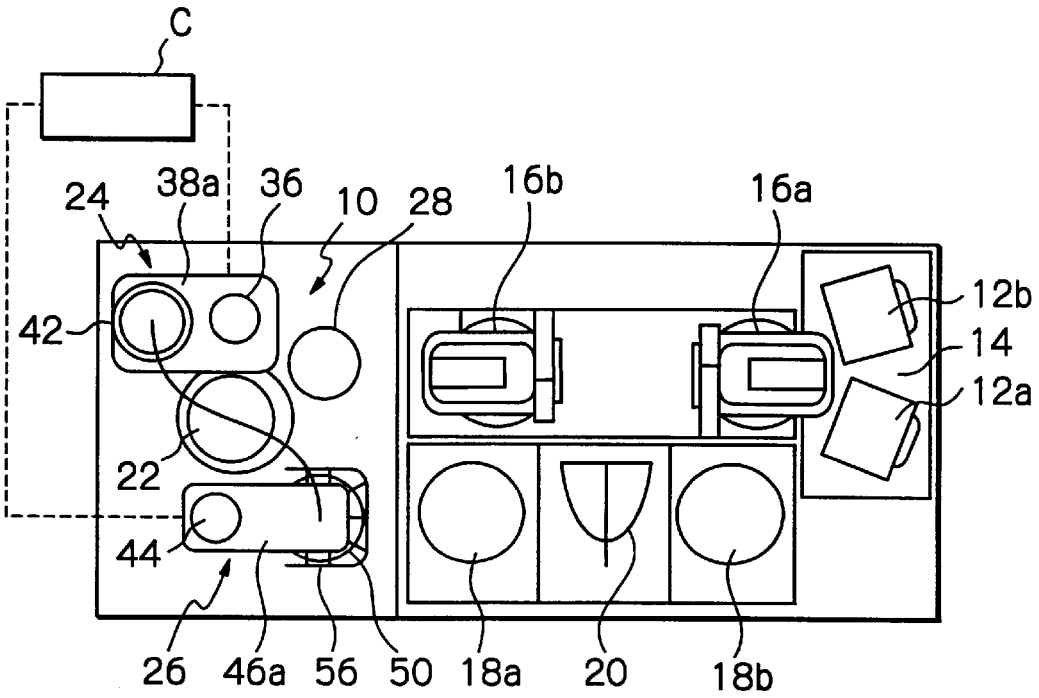
FIG. 1 is a plan view of a polishing apparatus in accordance with a first embodiment of the present invention.

With reference to FIG. 1, there is shown a polishing apparatus in accordance with a first embodiment of this invention.

As shown, the polishing apparatus is, as a whole, rectangular in its plan view configuration and includes a polishing station 10 located at the left end thereof and a wafer loading and unloading station 14 at the other end, including wafer storage cases 12*a* and 12*b*. Between the wafer loading and unloading station 14 and the polishing station 10, there are positioned wafer transfer robots 16*a* and 16*b* and cleaning devices 18*a* and 18*b* in parallel, with a wafer reverser 20 interposed between the cleaning devices.

The polishing station 10 includes a polishing table 22 positioned at the center thereof, a wafer carrier 24 and a dresser 26 positioned opposite sides of the polishing table 22. The arrangement of the wafer carrier 24 and the dresser 26 relative to the polishing table 22 enables the size of the polishing station 10 to be kept to a minimum. This arrangement also enables the dresser and the wafer carrier to operate with a low incidence of interference therebetween. Reference 28 designates a wafer transfer station to facilitate transfer of a wafer between the polishing station 10 and the transfer robot 16*b*.

Figure 2:
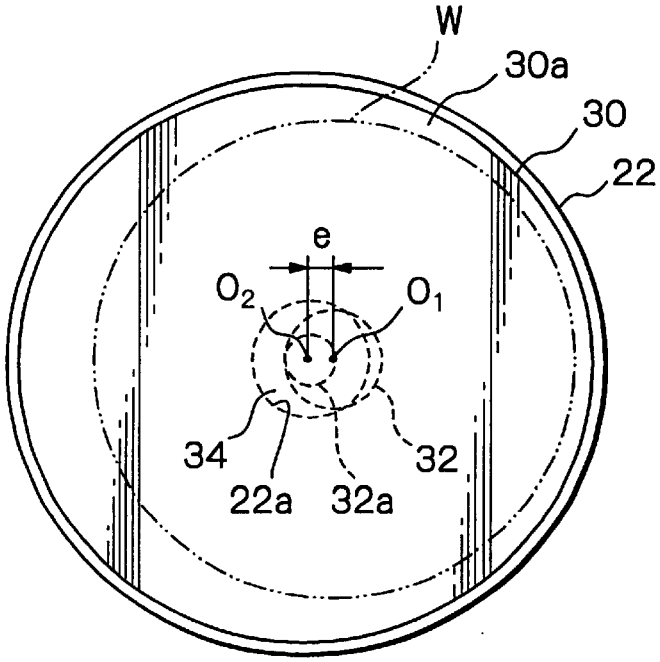
FIG. 2 is a plan view of a polishing table of the polishing apparatus of FIG. 1.
Figure 3:
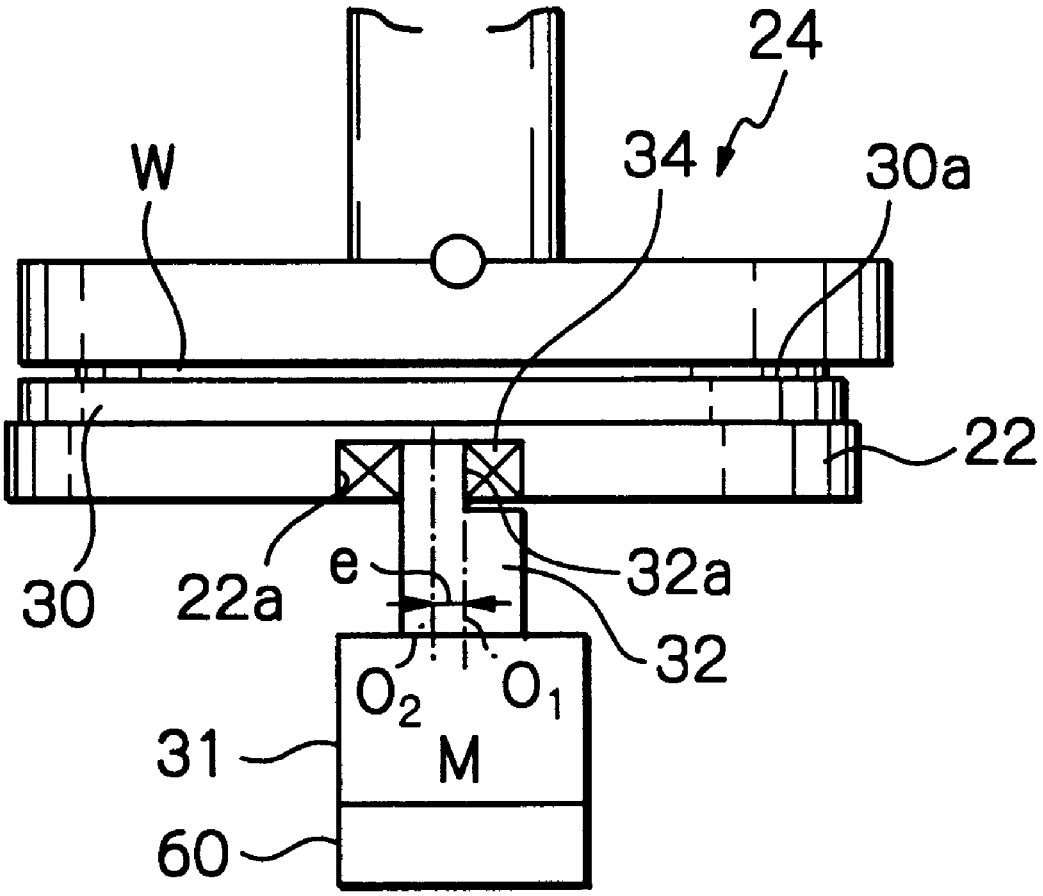
FIG. 3 is a side elevation view of the polishing table of FIG. 2.
Figure 4:
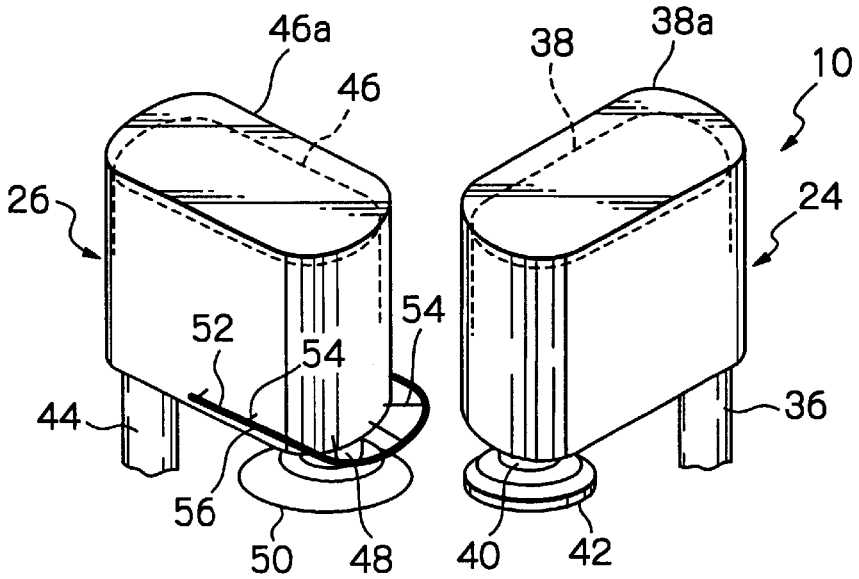
FIG. 4 is a perspective view of a wafer carrier and a dresser used in the polishing apparatus of FIG. 1.

With reference to FIGS. 2 and 3, the polishing table 22 is provided on its upper surface with a circular polishing member 30 such as a grindstone disc and a polishing cloth having a polishing surface 30*a* on the upper side thereof Below the polishing table 22, there is provided a motor 31 which drives the polishing table 22 by means of a drive train as explained below. The motor 31 includes a vertical output shaft 32 having a central axis $O_1$. The drive output shaft 32 is provided on its upper end face with an eccentric vertical drive pin 32*a* having a center axis $O_2$ which is offset from the center axis $\mathbf{0}_1$ by a distance "e". The top end of the drive pin 32*a* is rotatably received in a center hole of a radial bearing 34 which is, in turn, rotatably received in a recess 22*a* formed in the center of the bottom surface of the polishing table 22. Upon rotation of the output shaft 32 of the motor, the drive pin 32*a* is rotated about the central axis $O_1$ of the output shaft 32 and the radial bearing 34 is also rotated about the central axis $O_1$ of the output shaft 32 accordingly. The polishing table 22 is designed to be permitted to move in a horizontal plane normal to the axis $O_1$, but is prohibited from rotating about its central axis or the central axis $O_2$. As a consequence, due to the turning motion of the drive pin 32*a* as noted above, the polishing table 22 is subjected to a circulatory translational motion. In other words, the polishing table 22 is driven by the motor to turn about the central axis $O_1$ of the output shaft 32 of the motor 31 without any change in its orientation, i.e., without rotating about its own axis $O_2$.

The wafer carrier 24 includes a vertical strut 36, a carrier head 38 pivotably mounted on the top end of the strut 36 at a proximal end thereof and adapted to be pivoted about a vertical axis of the strut by means of an actuator such as a servomotor (not shown), a wafer carrying member 42 in the form of a disc, and a carrying member drive shaft 40 extending downwards from a distal end of the carrier head and connected at its lower end to the center of the carrying member 42. The drive shaft 40 is connected to a motor and a lift (not shown), both of which are mounted on the carrier head 38 so that the drive shaft 40 can be rotated about its axis and moved up and down while carrying or holding a wafer on the bottom surface of the carrying member 42. A polishing operation is conducted by lowering the carrying member 42 to bring the wafer W into contact with the polishing surface of the polishing member 30 while rotating the carrying member. The carrier head 38 is, as stated above, pivotable, so that the carrying member can be moved between a work position over the polishing table 22, a retracted position radially outside the polishing table 22 and a wafer transfer position over the wafer transfer station 28 in the polishing station 10. Reference 38*a* designates a cover covering the complete carrier head 38.

The dresser 26 likewise includes a vertical strut 44, a dresser head 46 pivotably mounted on the top end of the strut at its proximal end and adapted to be pivoted about a vertical axis of the strut 44 by means of an actuator such as a servomotor (not shown), a dressing tool 50 in the form of a disc, and a dressing tool drive shaft 48 extending downwards from a distal end of the dresser head 46 and connected to the center of the dresser tool 50 at its lower end. The drive shaft 48 is connected to a motor and a lift (not shown) both of which are mounted on the dresser head 46 so that the dresser tool 50 can be rotated about its axis and moved up and down. A dressing operation is conducted by bringing the dressing tool 50 into contact with the polishing surface of the polishing member 30 while rotating the dressing tool. The dresser head 46 is, as stated above, pivotable, so that the dressing tool can be moved between a work position over the polishing table 22 and a retracted position radially outside the polishing table 22. Reference 46*a* designates a cover covering the complete 15 dresser head 46.

Figure 5:
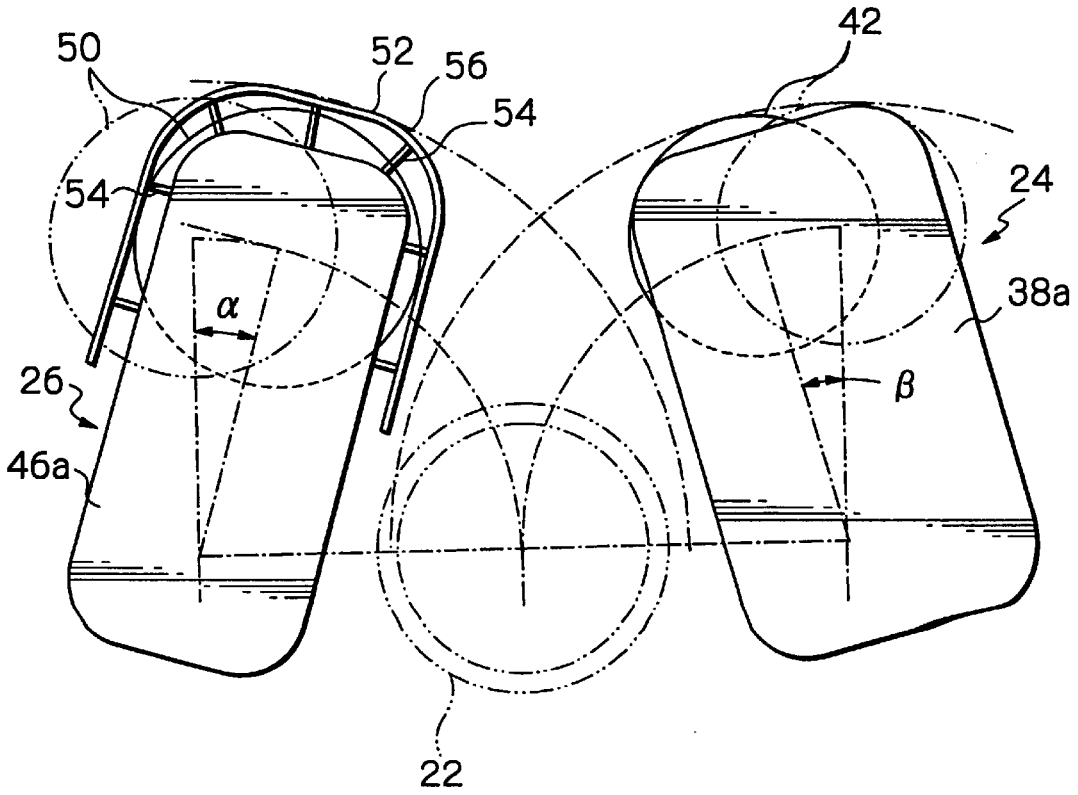
FIG. 5 is a plan view of the wafer carrier and the dresser of FIG. 4 showing their relationship in motion.

In this embodiment, there is provided a controller C (FIG. 1) for controlling the motors of the carrier head 38 and the dresser head 46 in such a manner that the carrier head 38 and the dresser head 46 are pivoted about the axes of the struts 36 and 44, respectively, without interfering with each other For example, sensors are provided to sense pivotal angles of the carrier head 38 and the dresser head 46 around the axes of the struts 36 and 44, respectively, and the controller C is adapted to control the pivotal motions of the carrier head 38 and the dresser head 46 on the basis of signals emitted from the sensors indicating the pivotal positions of the carrier head 38 and the dresser head 46. FIG. 5 shows an example of a positional relationship between the carrier head 38 and the dresser head 46 controlled by the controller C. In this example, the controller C commands the motor of the carrier head 38 to turn the carrier head 38 in a counterclockwise direction so that the carrier head 38 comes into the work position over the polishing table 22 only when the controller C has confirmed that the dresser head 46 is at its rest position located within an angular range a shown in FIG. 5, whereby the carrier head 38 can turn without any interference from the dresser head 46. Likewise, the controller C commands the motor of the dresser head 46 to turn the dresser head in a clockwise direction as viewed in FIG. 5 so that the dressing tool 50 comes into its work position over the polishing table only when it has been confirmed that the carrier head 38 is at its rest position located within an angular range 13, or at a position closer to the wafer transfer station than the rest position.

In this embodiment, the dresser head 46 is provided on its cover 46*a* with a contact type sensor 56. Specifically, the contact type sensor 56 is in the form of a character "U" and is separated from and supported around the lower portion of the dresser head cover 46*a* by means of a plurality of support members 54. The sensor 56 may include a pair of elongated electrical conductors which are arranged in parallel with each other in a U-form and held together at their opposite ends by insulating members such as insulation film members. The conductor may be prepared by plating a tape-like member made of a spring material with copper. If the carrier head 38 engages with the conductors, the conductors are electrically connected and close a circuit in the sensor 56 so as to activate the controller C to halt the pivotal movement of the carrier head 38 and/or the dresser head 46, and avoid damage being caused to the carrier head and/or the dresser head.

A contact type sensor of this type is highly resistant to atmospheric conditions, e.g., water and chemical proof. Further, a sensor of this type is inexpensive and easy to maintain, does not require complicated adjustment, and is readily replaceable and relatively freely configured. Although the contact type sensor is required to be brought into contact with the carrier head and the dresser head to be actuated, direct contact between the carrier head and the dresser head can be avoided by arranging the sensor so as to kept separate from the dresser head as shown in the above-noted embodiment.

Although in this embodiment, the sensor 56 is provided on the dresser head 46 taking into consideration a fact that the carrier head is often removed from the polishing apparatus for maintenance, the sensor may be mounted on the carrier head 38.

In operation, a wafer to be polished is removed from the wafer case 12*a* or 12*b* by the first wafer transfer robot 16*a*, and is then reversed by the reverser 20, and placed on the wafer transfer station 28 by the second wafer transfer robot 16*b*. Next, the controller C confirms that the dresser head 46 is positioned in its rest position located with the angular range a and then moves the carrier head 38 to a position over the wafer transfer station, where the wafer has been placed by the second transfer robot 16*b*, from its rest position located in the angular range. The wafer is then lifted towards the carrier head 38 and the carrier head in turn holds the wafer by its lower surface under a vacuum. The controller C further confirms that the dresser head is kept in the angular range a and then pivots the carrier head 38 to bring the carrying member 42 carrying the wafer W to its work position over the polishing surface 30*a* of the polishing table 22.

The carrying member 42 is then rotated about its axis and lowered to be brought into contact with the polishing surface 30*a* of the polishing member 30 on the polishing table 22 which is subject to the circulatory translational motion as stated above. After polishing of the wafer W, the carrying member 42 is lifted and moved towards the wafer transfer station 28 to bring the carrying member 42 to a position over the wafer transfer station 28 after the control confirms that the dresser head 46 is at its rest position.

The controller C then confirms that the carrying member 42 resides at its position over the wafer transfer station 28 and, thereafter, pivots the dresser head 46, which was positioned at its rest position, to bring the dressing tool 50 to its position over the polishing surface 30*a* on the polishing table 22. The dressing tool is then rotated at low speed and lowered to be brought into contact with the polishing surface 30*a* on the polishing table which is subject to a circulatory translational motion, whereby a dressing operation is conducted on the polishing surface 30*a*.

After completion of the dressing operation, the dressing tool 50 is lifted and then moved to its rest position upon confirmation by the controller C that the carrier head is at its designated position over the wafer transfer station 28. At the rest position of the dressing tool 50 there is provided a cleaning device for the dressing tool.

Simultaneously with or following the dressing operation, the polished wafer W is transferred from the carrying member 42 to the wafer transfer station 28, while being washed with pure water or rinsing liquid as required.

In this embodiment, in the event of an impending approach of the carrier head 38 and the dresser head in spite of the operation of the controller C as stated above, the contact type sensor 56 is able to sense such an approach whereby any pivotal movements of the carrier head 38 and the dresser head 46 are caused to instantaneously cease, so as to avoid collision therebetween. Such a protection function is of use when the polishing apparatus is being controlled manually, for example, during adjustment of the polishing apparatus subsequent to installation.

The polished wafer W placed on the wafer transfer station is then transferred by the second transfer robot 16*b* to the first cleaning device 18*a* where opposite side surfaces of the wafer are cleaned using, for example, sponge rolls and, thereafter, is transferred to and reversed by means of the reverser 20. The reversed wafer is then picked up by the first wafer transfer robot 16*a* and placed on the second cleaning device 18*b*, which is designed to conduct a cleaning operation, for example, by means of a pen-type sponge cleaning member and a spin dry operation with respect to the upper surface of the wafer, and is finally transferred to the loading and unloading station including the wafer cases 12*a* and 12*b*.

In the first embodiment stated above, the dresser is of a contact type. However, this invention can also be applied to a polishing apparatus including a non-contact type dresser in the form of, for example, a fluid jet adapted to direct a jet of air, nitrogen gas, water or other fluids.

Figure 6:
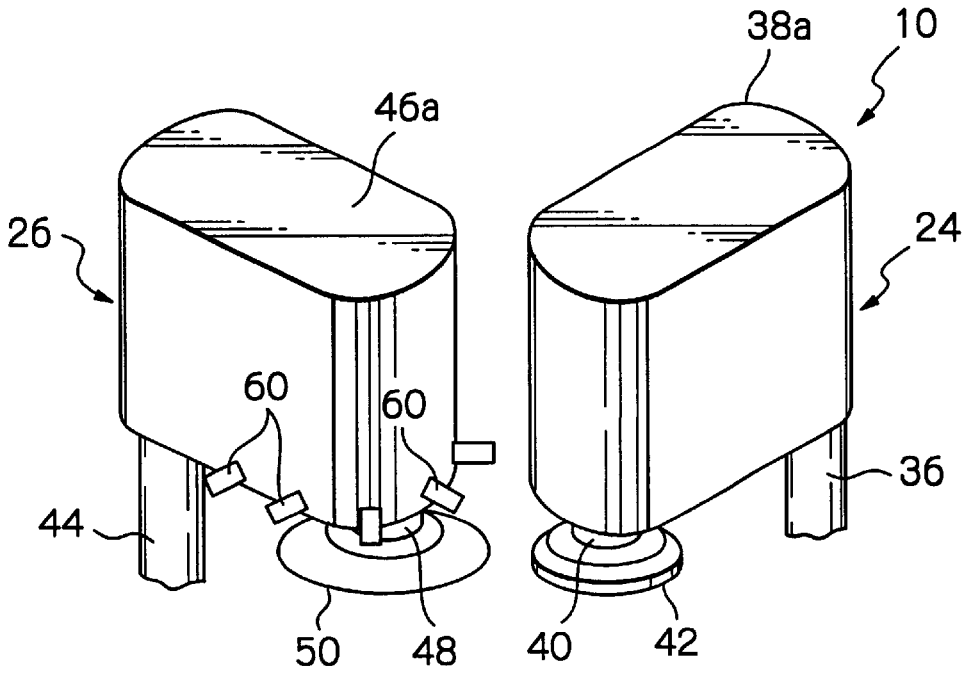
FIG. 6 is a perspective view of a wafer carrier and a dresser in accordance with another embodiment of the present invention.

FIG. 6 shows a second embodiment of the present invention in which, instead of the contact type sensor in the first embodiment, a plurality of proximity switches 60 are provided on an area on the lower surface of the dresser cover 46*a*, which area may be engaged with the carrier cover 38*a*. As shown, the proximity switches 60 are separated from each other by predetermined distances.

Figure 7:
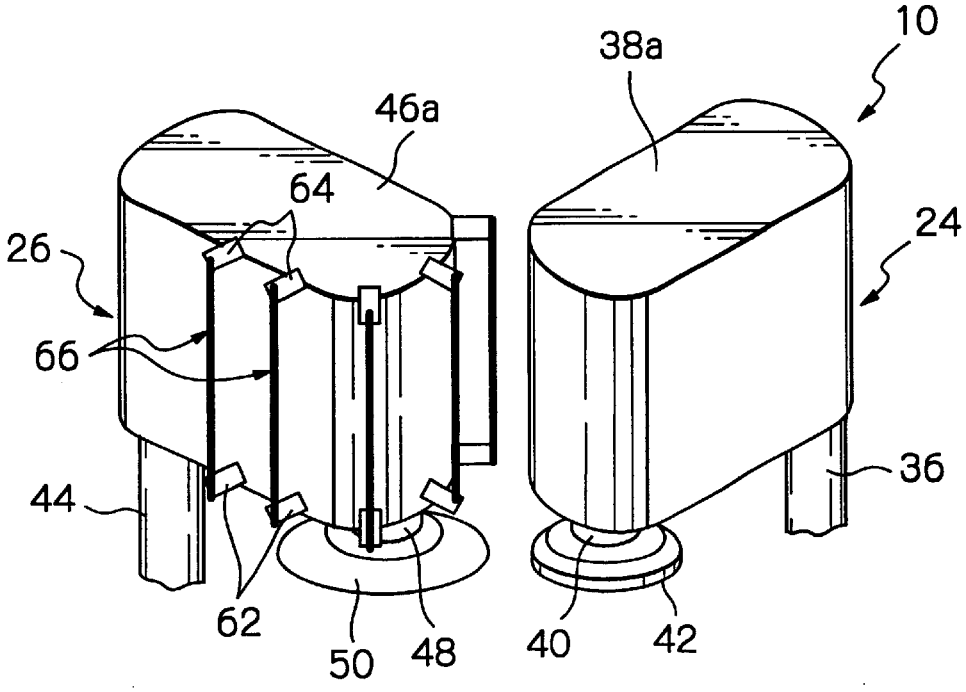
FIG. 7 is a perspective view showing a variation of the wafer carrier and dresser of FIG. 6.

FIG. 7 shows a third embodiment of the present invention which employs, in place of the proximity switches 60 in the second embodiment, photoswitches 66 each including light emitters 62 and light receivers 64.

In the second and third embodiments, an inappropriate approach between the carrier head 38 and the dresser head 46 is sensed by the proximity switches 60 and photoswitches 66, respectively, without any direct contact between the carrier head 38 and the dresser head 46. It should be noted that, in order to sense an inappropriate approach between the carrier head and the dresser head, a single switch may be appropriately employed in place of a plurality of switches as disclosed in the second and third embodiments.

Figure 8:
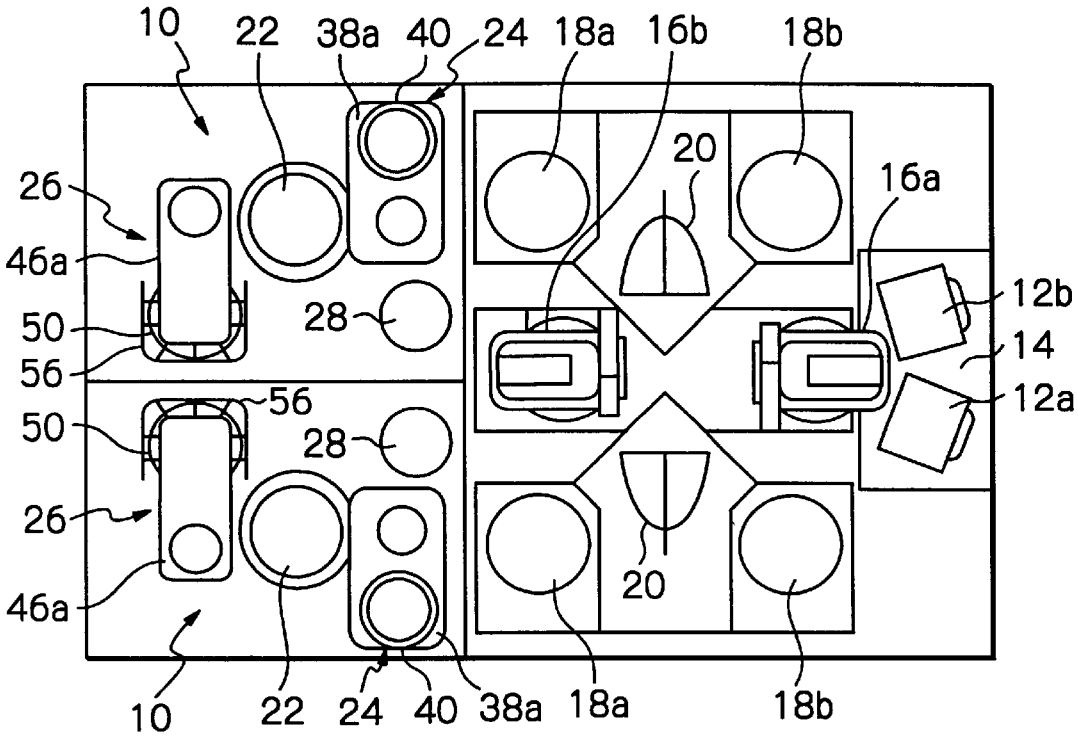
FIG. 8 is a plan view of a polishing apparatus in accordance with a different embodiment of the present invention.

FIG. 8 shows a polishing apparatus in accordance with a fourth embodiment of the present invention. The apparatus includes a pair of polishing stations 10, 10. For each of the polishing stations, there is provided two cleaning devices 18*a* and 18*b* and a single reverser 20 which are arranged in a line. The apparatus further includes first and second wafer transfer robots 16*a* and 16*b* arranged in a line between and in parallel with the lines of the cleaning devices 18*a* and 18*b* and the single reverser 20 and a single loading and unloading station 14 positioned at an end of the apparatus opposite the end where the polishing stations 10 and 10 are provided. The polishing apparatus of this embodiment makes it possible for one of the polishing stations to conduct a polishing operation of a wafer, while the other polishing station is conducting a dressing operation. In accordance with this embodiment, a pair of the first and second wafer transfer robots 16*a* and 16*b* is adapted to be used for both of the polishing stations 10 and 10 thereby enabling the polishing apparatus to polish a great number of wafers per unit area of an installation as compared with the polishing apparatus in accordance with the first embodiment where a pair of the wafer transfer robots 16*a* and 16*b* is used only for the single polishing station 10.

Figure 9:
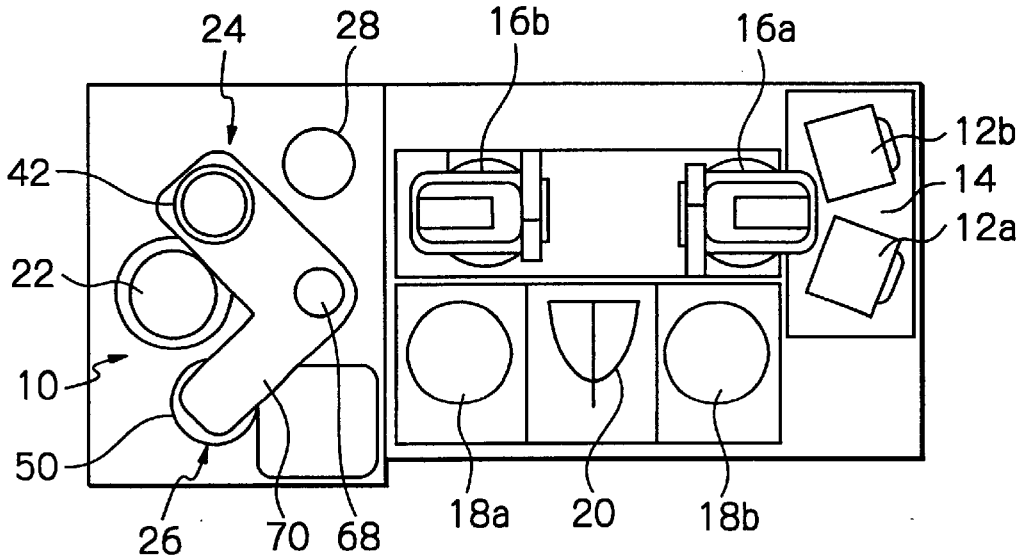
FIG. 9 is a plan view of a polishing apparatus in accordance with a further different embodiment of the present invention.

FIG. 9 shows a polishing apparatus in accordance with a fifth embodiment of the present invention which includes in the polishing station 10, a single bell-crank type head 70 provided at its opposite ends with the carrying member 42 and the dressing tool 50, respectively. The head 70 is pivotably supported by a vertical strut 68 laterally spaced from the polishing table 22. In this apparatus, the carrying member 42 and the dressing tool 50 are simultaneously moved between their work and rest positions in opposite directions relative to each other by pivotal movement of the head 70 about the strut 68, in order to avoid any contact therebetween. The apparatus therefore needs no collision prevention means, such as is described with reference to FIGS. 4–7.

Figure 10:
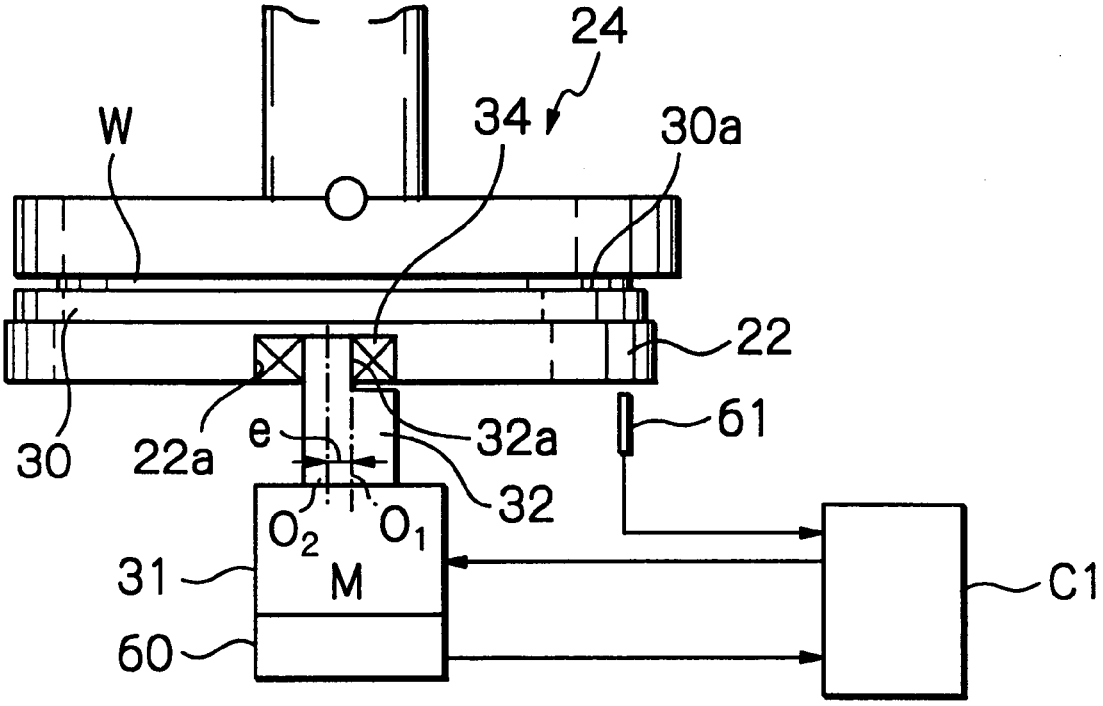
FIG. 10 is a side elevation view of a wafer carrier and a polishing table in accordance with another embodiment of the present invention.

FIG. 10 shows another embodiment of the present invention which employs a controller C1 for halting the polishing table 22 at a fixed or predetermined position relative to the central axis $O_1$ of the output shaft of the motor 31 when a polishing operation is completed. As shown, the controller C1 is connected to an encoder 60 provided on the motor 31 and generates pulse signals representing rotational movement of the output shaft 32 of the motor and a detector 61, which is positioned under the polishing table 22 to detect a particular reference point provided on the lower surface of the polishing table 22 and passing thereover.

Figure 11A:
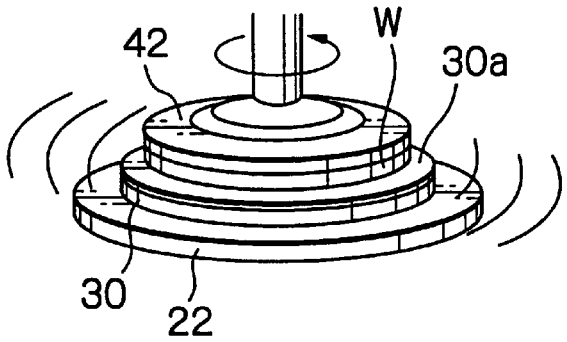
FIG. 11*a* is a perspective view of the polishing table and the wafer carrier in a polishing operation.
Figure 11B:
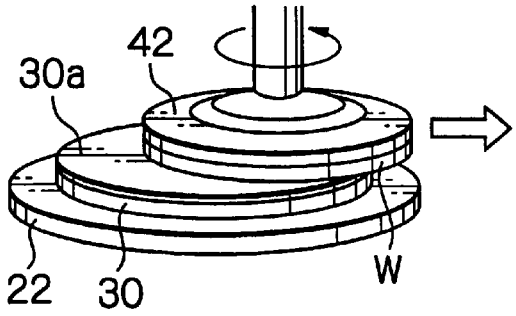
FIG. 11*b* is a perspective view of the polishing table and the wafer carrier showing a state in which the wafer carrier has started to move laterally relative to the polishing table.
Figure 11C:
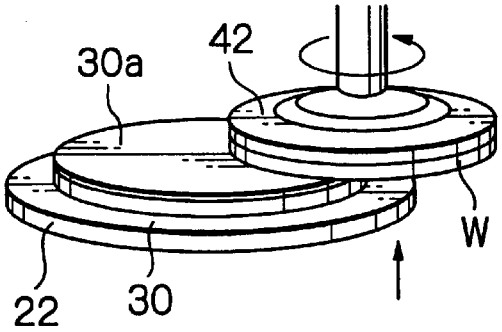
FIG. 11*c* is a perspective view of the polishing table and the wafer carrier showing a state in which the wafer carrier has been moved to a predetermined position relative to the polishing table from which the wafer carrier should be lifted.
Figure 11D:
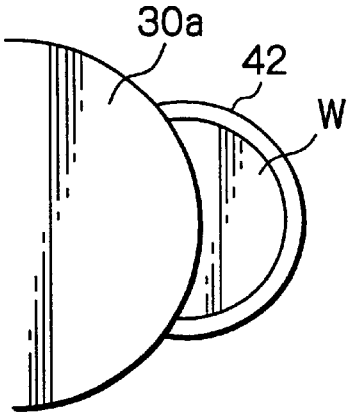
FIG. 11*d* is a bottom view of the polishing table and the wafer carrier of FIG. 11*c*.
Figure 11E:
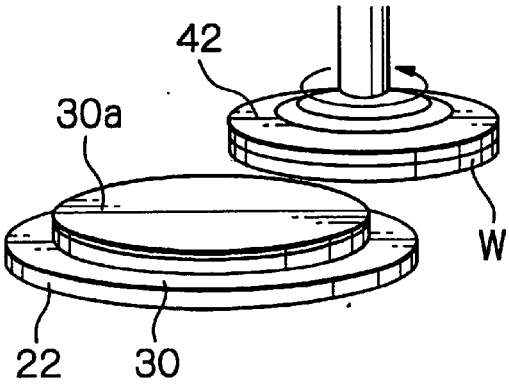
FIG. 11*e* is a perspective view of the polishing table and the wafer carrier showing a state that the wafer carrier has lifted separating from the polishing table.
Figure 12:
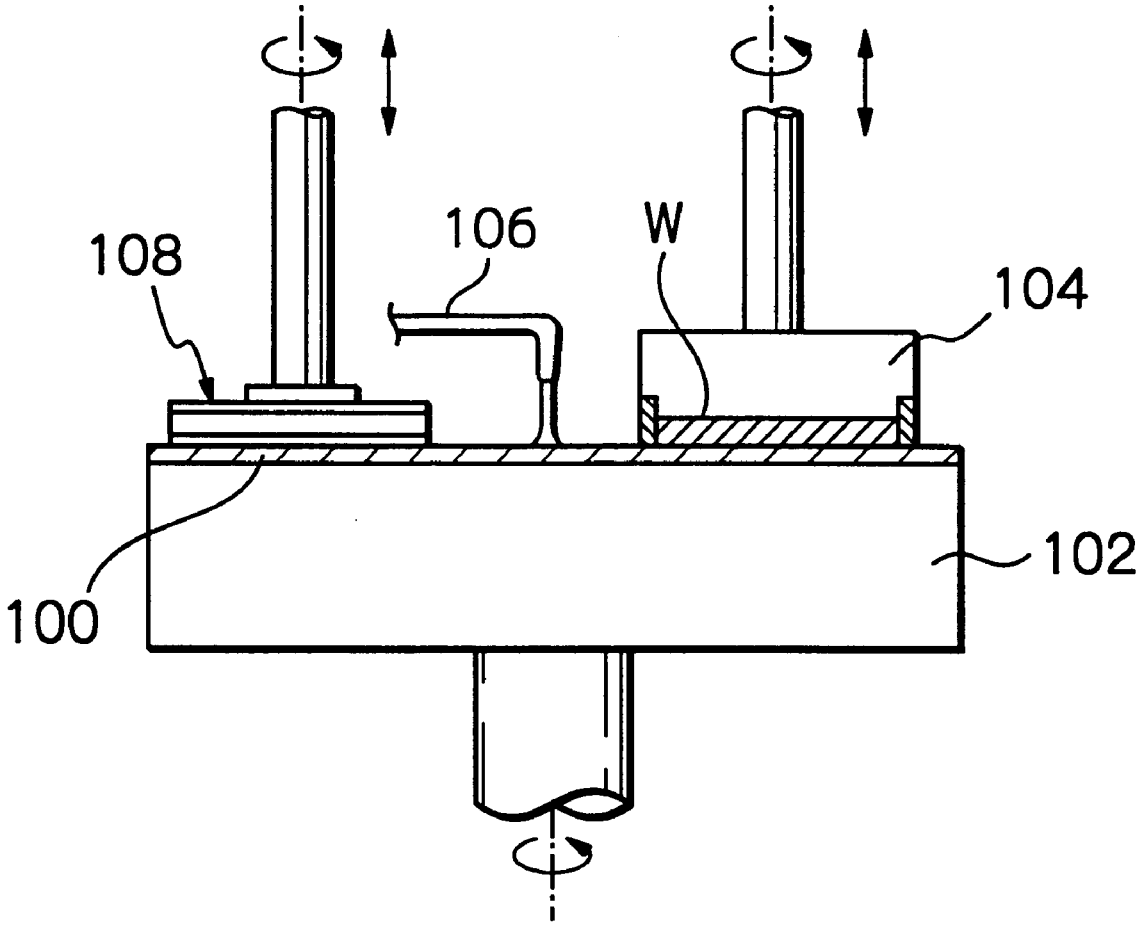
FIG. 12 is a side elevation view of a prior art polishing apparatus.

The controller C1 operates as follows. At such a time as it has been determined that a wafer polishing operation is complete, the detector 61 detects the reference point on the lower surface of the polishing table 22 passing over the detector 61 at that time and delivers a signal representing the detection of the reference point to the controller C1. The controller then starts counting the pulses delivered from the encoder 60. When the number of the pluses counted by the controller C1 reaches a predetermined value which is stored in the controller C1 in advance, the controller C1 stops the operation of the motor 31. As a result, the polishing table 22 is halted at a predetermined position relative to the central axis $O_1$. Accordingly, in this embodiment, it is possible for the wafer carrying member 42 to place the wafer W carried by the carrying member 42 at a fixed position relative to the polishing surface 30*a* where a predetermined area of the wafer W facing the polishing surface 30*a* extends radially outwardly beyond the peripheral edge of the polishing surface 30*a*, merely by pivoting the carrier head 38 about its strut 36 by a predetermined angle after movement of the polishing table 22 is halted following completion of a polishing operation. Specifically, as shown in FIG. 11*a*, during a wafer polishing operation, the carrying member 42 carrying a wafer W is rotated about its axis while the polishing table 22 provided with the polishing member 30 is subjected to a circulatory translational motion. Following completion of a wafer polishing operation, the translation motion of the polishing table is halted as stated above so that the polishing surface 30*a* is positioned at a predetermined position relative to the axis $O_1$, of the output shaft of the motor. Then, the wafer carrier head 38 is pivoted about its strut 36 through a predetermined angle with the carrying member 42, as shown in FIG. 11*b*, continuing to be rotated and kept in contact with the polishing surface 30*a*. It is desirable that, when the carrier head has been turned through a predetermined angle, the surface of the wafer W is placed in such a manner that it extends radially outwardly from the peripheral edge of the polishing surface by around twenty to fifty percent of its overall surface area, for example, as shown in FIGS. 11*c* and 11*d*. Although as the range of extension increases, the surface tension decreases thereby facilitating separation of a polished wafer from the polishing surface 30*a*, as the center of the surface of the wafer approaches the peripheral edge of the polishing surface, it becomes increasingly difficult for the wafer carrying member 42 to maintain its attitude. It is therefore preferable for the range of extension noted above not to exceed around fifty percent of the overall surface area of the wafer. Then, the wafer W can be separated from the polishing surface 30*a*, as shown in FIG. 11*e*.

According to a variation of the embodiment of FIG. 10, a polishing apparatus may include a controller which is adapted to sense a position of the polishing table 22 which has been halted after a wafer polishing operation and to then command the motor for the carrier head to turn the carrier head through an angle which is determined on the basis of the sensed position of the polishing table relative to the center axis $O_1$, so that the wafer is brought to a position where the surface of the wafer extends beyond the peripheral edge of the polishing surface by a desired percentage of the overall surface area of the wafer. Further, the position control of the carrier head relative to the polishing table as explained with reference to FIG. 10 can be applied to relative positions between the polishing table and the dresser head.

It should be noted that the present invention is not necessarily limited to the foregoing embodiments, and can be modified in a variety of ways without departing from the gist of the present invention.

What is claimed is:

1. A polishing apparatus comprising:

a polishing table having a polishing surface;

a carrier for carrying a plate-like member and bringing the plate-like member into contact with said polishing surface, said carrier being movable along a first path between a work position for bringing the plate-like member into contact with said polishing surface and a rest position radially outside said polishing surface; and a dresser including a dressing tool adapted to be brought into contact with said polishing surface to dress or normalize said polishing surface, said dresser being movable along a second path between a work position for bringing said dressing tool into contact with said polishing surface and a rest position radially outside said polishing surface, the second path and the first path having a common area overlapping with each other.

2. A polishing apparatus as set forth in claim 1, further comprising a contact preventor operable to prevent said carrier and said dresser from coming into contact with each other.

3. A polishing apparatus as set forth in claim 2, wherein said contact preventor is adapted to prevent said carrier and said dresser from entering the common area at a same time.

4. A polishing apparatus as set forth in claim 3, wherein said contact preventor includes a controller operable to determine where said carrier and said dresser are positioned and to allow one of said carrier and said dresser to move along the path thereof after determining that the other of said carrier and said dresser has not entered into the common area.

5. A polishing apparatus as set forth in claim 1, further comprising at least one sensor operable to sense a state that said carrier and said dresser have approached each other beyond a predetermined limit, whereby movement of at least one of said carrier and said dresser is halted upon detection of the state by said at least one sensor.

6. A polishing apparatus as set forth in claim 2, further comprising at least one sensor operable to sense a state that said carrier and said dresser have approached each other beyond a predetermined limit, whereby movement of at least one of said carrier and said dresser is halted upon detection of the state by said at least one sensor.

7. A polishing apparatus as set forth in claim 3, further comprising at least one sensor operable to sense a state that said carrier and said dresser have approached each other beyond a predetermined limit, whereby movement of at least one of said carrier and said dresser is halted upon detection of the state by said st least one sensor.

8. A polishing apparatus as set forth in claim 4, further comprising at least one sensor operable to sense a state that said carrier and said dresser have approached each other beyond a predetermined limit, whereby movement of at least one of said carrier and said dresser is halted upon detection of the state by said at least one sensor.

9. A polishing apparatus as set forth in claim 1, wherein said carrier includes an axis about which said carrier is pivoted between the work position and the rest position thereof and said dresser includes an axis about which said dresser is pivoted between the work position and the rest position thereof, said axis of said carrier and said axis of said dresser being positioned at diametrically opposite sides of said polishing table.

10. A polishing apparatus as set forth in claim 2, wherein said carrier includes an axis about which said carrier is pivoted between the work position and the rest position thereof and said dresser includes an axis about which said dresser is pivoted between the work position and the rest position thereof, said axis of said carrier and said axis of said dresser being positioned at diametrically opposite sides of said polishing table.

11. A polishing apparatus as set forth in claim 3, wherein said carrier includes an axis about which said carrier is pivoted between the work position and the rest position thereof and said dresser includes an axis about which said dresser is pivoted between the work position and the rest position thereof, said axis of said carrier and said axis of said dresser being positioned at diametrically opposite sides of said polishing table.

12. A polishing apparatus as set forth in claim 4, wherein said carrier includes an axis about which said carrier is pivoted between the work position and the rest position thereof and said dresser includes an axis about which said dresser is pivoted between the work position and the rest position thereof, said axis of said carrier and said axis of said dresser being positioned at diametrically opposite sides of said polishing table.

13. A polishing apparatus as set forth in claim 1, wherein said carrier and said dresser are mechanically connected to each other so that both of said carrier and said dresser are moved simultaneously along the first path and the second path, respectively.

14. A polishing apparatus comprising:

a polishing table having a polishing surface;

a carrier for carrying a plate-like member and bringing the plate-like member into contact with said polishing surface, said carrier being movable along a first path between a work position for bringing the plate-like member into contact with said polishing surface to polish the plate-like member and a rest position spaced away from the work position;

a dresser for dressing or normalizing said polishing surface, said dresser being movable along a second path between a work position for dressing or normalizing said polishing surface and a rest position spaced away from the work position, the second path and the first path having a common area overlapping with each other; and a sensor for sensing a state that said carrier and said dresser have approached each other beyond a predetermined limit, thereby preventing said carrier and said dresser from coming into contact with each other.

15. A polishing apparatus as set forth in claim 14, wherein said sensor is mounted on at least one of said carrier and said dresser.

16. A polishing apparatus comprising:

a polishing table having a polishing surface;

a carrier for carrying a plate-like member and bringing the plate-like member into contact with said polishing surface to polish a surface of the plate-like member;

a circulatory translational motion mechanism for generating a relative circulatory translational motion between said polishing table and said carrier while maintaining the contact of the plate-like member with said polishing surface; and an actuator for moving said carrier relative to said polishing surface, while maintaining the contact of the plate-like member with said polishing surface, to bring the plate-like member into a condition that a predetermined area of the surface of the plate-like member extends beyond a peripheral edge of said polishing surface.

17. A polishing apparatus as set forth in claim 16, further comprising a controller operable to halt said circulatory translational motion mechanism in a state where the plate-like member is positioned at a predetermined position relative to said polishing surface.

18. A polishing apparatus as set forth in claim 17, further comprising a sensor positioned adjacent to said polishing table for sensing a state that a predetermined reference point on said polishing table has passed said sensor and generating a signal indicating the state, wherein said circulatory translational motion mechanism generates a circulatory translational motion of said polishing table while said carrier is positioned at a predetermined position, and said controller is adapted to halt the circulatory translational motion when said polishing table has come to the predetermined position with reference to the signal generated by said sensor.

19. A polishing apparatus as set forth in claim 1, wherein the plate-like member is a semiconductor wafer.

20. A polishing apparatus as set forth in claim 14, wherein the plate-like member is a semiconductor wafer.

21. A polishing apparatus as set forth in claim 16, wherein the plate-like member is a semiconductor wafer.

* * * * *